US012638263B2

(12) United States Patent
Pauley

(10) Patent No.: US 12,638,263 B2
(45) Date of Patent: May 26, 2026

(54) DROP-A-WAY DUAL MODE ARCHERY BOW REST FOR ARROWS

(71) Applicant: Specialty Archery LLC, Spencer, IA (US)

(72) Inventor: Andrew T. Pauley, Spencer, IA (US)

( * ) Notice: Subject to any disclaimer, the term of this patent is extended or adjusted under 35 U.S.C. 154(b) by 161 days.

(21) Appl. No.: 18/416,192

(22) Filed: Jan. 18, 2024

(65) Prior Publication Data

US 2024/0240909 A1 Jul. 18, 2024

Related U.S. Application Data

(60) Provisional application No. 63/480,433, filed on Jan. 18, 2023.

(51) Int. Cl.
*F41B 5/22* (2006.01)
*F41B 5/10* (2006.01)
*F41B 5/14* (2006.01)

(52) U.S. Cl.
CPC ..... *F41B 5/143* (2013.01); *F41B 5/105* (2013.01)

(58) Field of Classification Search
CPC ..... F41B 5/143
See application file for complete search history.

(56) References Cited

U.S. PATENT DOCUMENTS 5,062,407 A * 11/1991 Newbold ..... F41B 5/143 124/44.5
5,095,884 A * 3/1992 Mertens ..... F41B 5/1438 124/44.5
5,285,764 A * 2/1994 Mertens ..... F41B 5/1438 124/44.5
5,400,763 A * 3/1995 Mazza ..... F41B 5/143 124/44.5
5,476,086 A * 12/1995 Smith ..... F41B 5/143 124/44.5
5,555,875 A * 9/1996 Martin ..... F41B 5/143 124/44.5
6,044,832 A * 4/2000 Piersons, Jr. ..... F41B 5/143 124/44.5
7,219,662 B1 * 5/2007 Henry ..... F41B 5/143 124/44.5
8,544,457 B1 * 10/2013 Munsell ..... F41B 5/143 124/44.5
11,635,276 B2 * 4/2023 Munsell ..... F41B 5/143 124/44.5
2006/0162709 A1 * 7/2006 Roberts ..... F41B 5/143 124/44.5

* cited by examiner

*Primary Examiner* — John A Ricci
(74) *Attorney, Agent, or Firm* — Gerald E. Helget; Taft Stettinius & Hollister LLP

(57) ABSTRACT

A drop-a-way dual mode archery bow rest for supporting an arrow as the bow is drawn is releasably mounted on the riser of a compound bow. The bow rest includes a housing with enclosed left and right sides and is adjustable in the X, Y and Z axes. In the housing are at least two slidably connected, rotatable, biased, horizontally- and axially-aligned arrow rest shafts mounted in the left and the right sides of the housing. The shafts are rotatably and movably connected by an axially-aligned indexing shaft. A launcher is attached to one of the shafts, operating from a downward position or an upward, ready-to-shoot position, lightly supporting the arrow. At least one shaft is connected to a cable connected to the bow string, lower limb or bow cables to pull the arrow rest and launcher into a biased position for launch functionality.

21 Claims, 17 Drawing Sheets

DROP-A-WAY DUAL MODE ARCHERY BOW REST FOR ARROWS

BACKGROUND OF THE INVENTION

The present invention relates to archery bow arrow rests, and more particularly to a compound archery bow that is capable of shooting arrows well in excess of three hundred (300) feet per second. Compound archery bows commonly have any of a variety of styled arrow rests. Such varieties include fixed arrow rests that are fixed on the riser of bow just above the hand grip. Other arrow rests are full containment rests that completely surrounds the arrow as to prevent the arrow from falling out of position and creating a misfire. Drop-a-way arrow rest have greatly improved and are desirous of many archers in today's world of archery due to these rests moving down and out of the away from the arrow as it is shot from the bow as to not in any way touch or deflect the flying arrow or its fletching or feathers at the knock end of the arrow and cause the arrow to deviate from its intended target.

Bows and arrows in the hunting world must remain extremely quiet as to not 'spook' the wild animal when the hunter shoots an arrow at his or her big game target. This requirement is also true for mechanical drop-a-way arrow rests as the launcher is required to quietly move out of the way of the arrow in less than a split second. Also, for a drop-a-way arrow rest to be successful as desired by bow shooters, the arrow rest must be extremely fast and accurate. The arrow should not be prone to falling out of the arrow rest which typically results in the archer missing his shooting opportunity. The arrow should not be gripped by the launcher but simply sits in a semi-circular launcher or a V-shaped launcher with minimal contact with the launcher. It is important that the launcher readily moves out of the way of the arrow as the flying arrow is launched.

Some drop-a-way arrow rests are designed to move upwardly to lift up and lightly hold the arrow as the archer draws the bow string back effectively 'cocking' the bow and making it ready to shoot the arrow suitably with a hand held trigger activated release. These rests have a cable connected to the bow string, lower limb or bow cables to pull the arrow rest into a biased position for functionality. Thereafter, the launcher must immediately drop down and away from the flying arrow as to not interfere with its intended flight.

Other drop-a-way arrow rests are designed to generally be in the upward ready to shoot position lightly holding or supporting the arrow from below. The archer draws the bow string back effectively 'cocking' the bow and making it ready to shoot the arrow suitably with a hand held trigger activated release. Thereafter, the launcher must immediately drop down and away from the flying arrow as to not interfere with its intended flight.

There is a need for a drop-a-way arrow rest that is fast, quite, readily adjustable and operable from either the launcher being in the at rest down and out of the way position to lifting and lightly holding the arrow in shooting position as the archer draws the bow string back making it ready to shoot the arrow suitably with a hand held trigger activated release. Thereafter, the launcher must immediately drop down and away from the flying arrow as to not interfere with its intended flight. The drop-a-way arrow rest may operate in the upward, ready-to-shoot position lightly holding or supporting the arrow from below. As the archer draws the bow string back, effectively 'cocking' the bow, this action makes the bow ready to shoot the arrow suitably with a hand held trigger activated release. Thereafter, the launcher would also immediately drop down and away from the flying arrow as to not interfere with its intended flight.

SUMMARY OF THE INVENTION

A drop-a-way dual mode archery bow rest for supporting an arrow as the bow is drawn back to shoot the arrow is releasably mounted on the riser of a compound archery bow. The bow rest comprising a housing having an enclosed left and right sides and is adjustable in the X, Y and Z axes relative to the bow. Within the housing are positioned at least two slidably connected, rotatable, biased, horizontally and axially aligned launcher shafts mounted in the left and the right sides of the housing. An arrow launcher is attached to the one of the shafts. At least one of the shafts is connected to a cable which is turn is connected to the bow string, lower limb or bow cables to pull the arrow rest into a biased position for launch functionality.

A principal object and advantage of the present invention is that the drop-a-way dual mode archery bow rest is capable of having its launcher being in the at rest down and out of the way position to lifting and lightly holding the arrow in shooting position as the archer draws the bow string back. Alternatively, the archery bow rest may operate in the upward, ready-to-shoot position lightly holding or supporting the arrow from below. As the archer draws the bow string back effectively 'cocking' the bow, this action makes the bow ready to shoot the arrow.

The archery bow rest of the present invention may have an arrow containment hoop or upside down U-shaped hoop to complement the arrow rest and thereby fully contain the arrow within the arrow rest.

Another object and advantage of the present invention is that all aspects of the arrow rest are fully adjustable to include rest adjustment in the X, Y and Z axes, the launcher adjustment to desired position in the down-position as well as the up- and arrow supportive-position, and tension adjustments for the biasing of the launcher from its upward position to it quick moving downward out of the way position.

Another object and advantage of the present invention is that the arrow rest is easily removed from the bow with the removal of one knurled knob and screw for easy storage of the arrow rest when not in use.

Another object and advantage of the present invention is that the arrow rest can easily mount, for use, a variety of arrow launcher shapes as desired by the archer.

DETAILED SPECIFICATION

Figure 1:
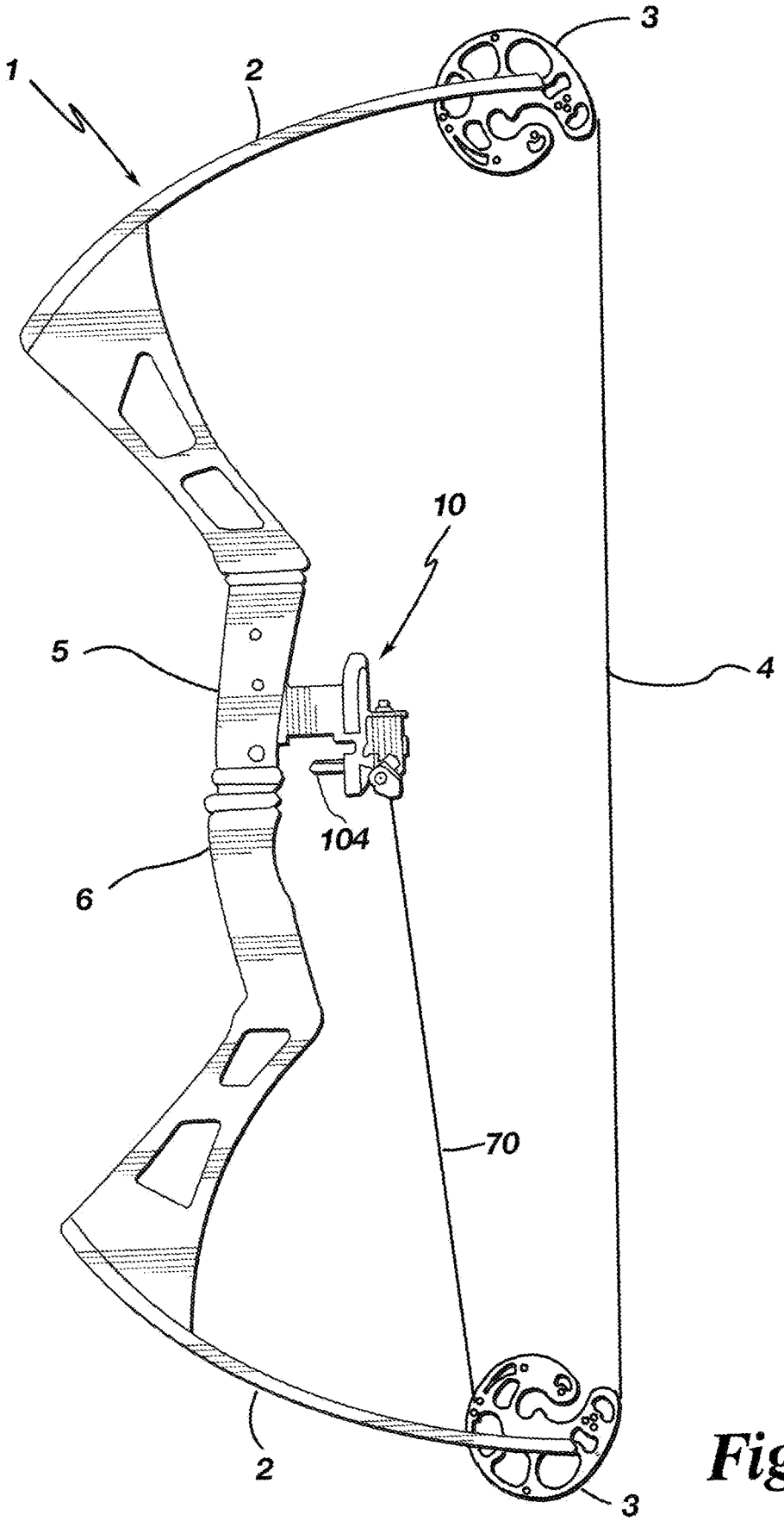
FIG. 1 is a side elevational view of a compound bow with the drop-a-way dual mode archery rest in rest position of the present invention.
Figure 2:
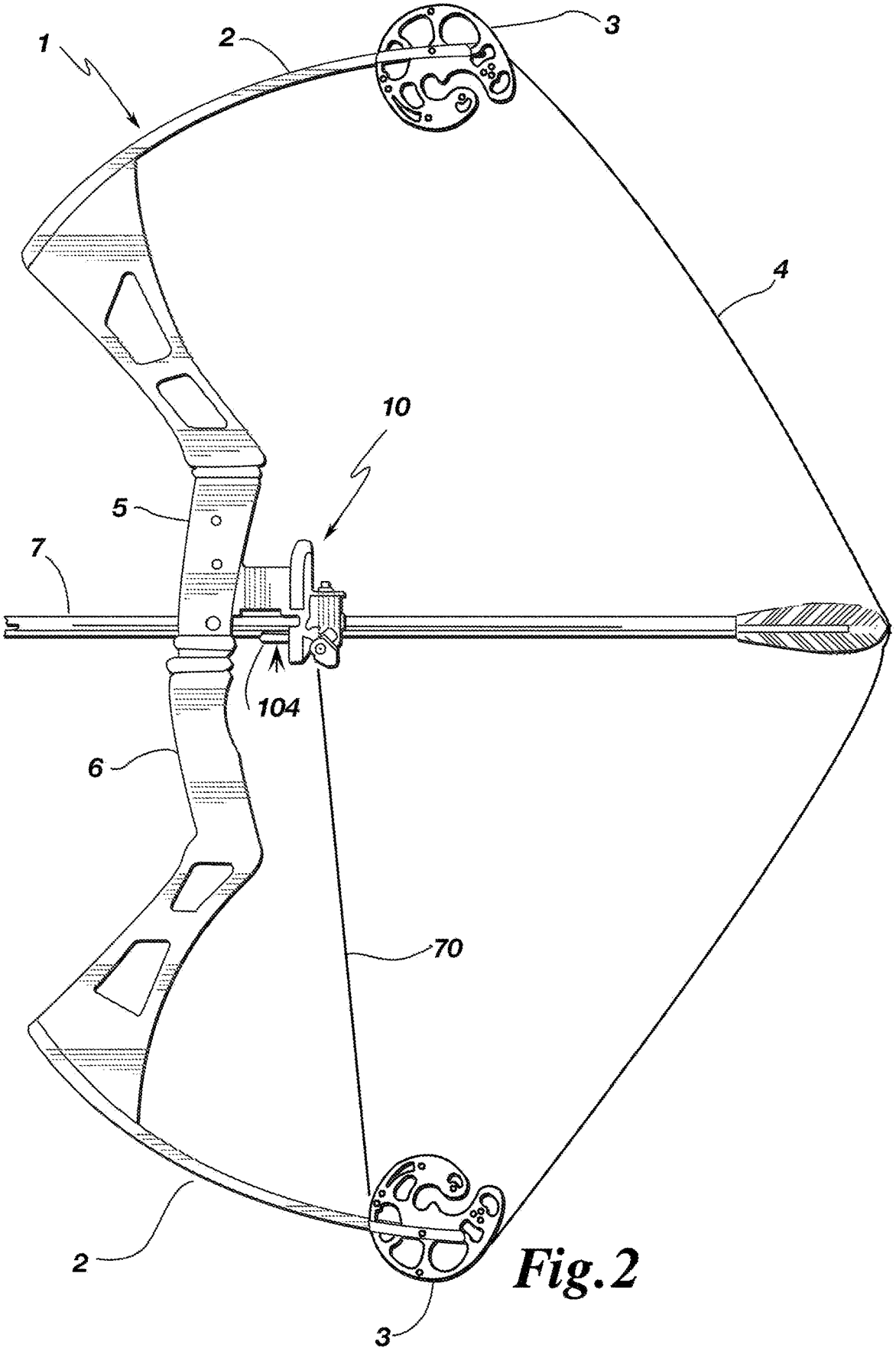
FIG. 2 is a side elevational view of a compound bow with the drop-a-way dual mode archery rest in partially drawn position of the present invention.
Figure 3:
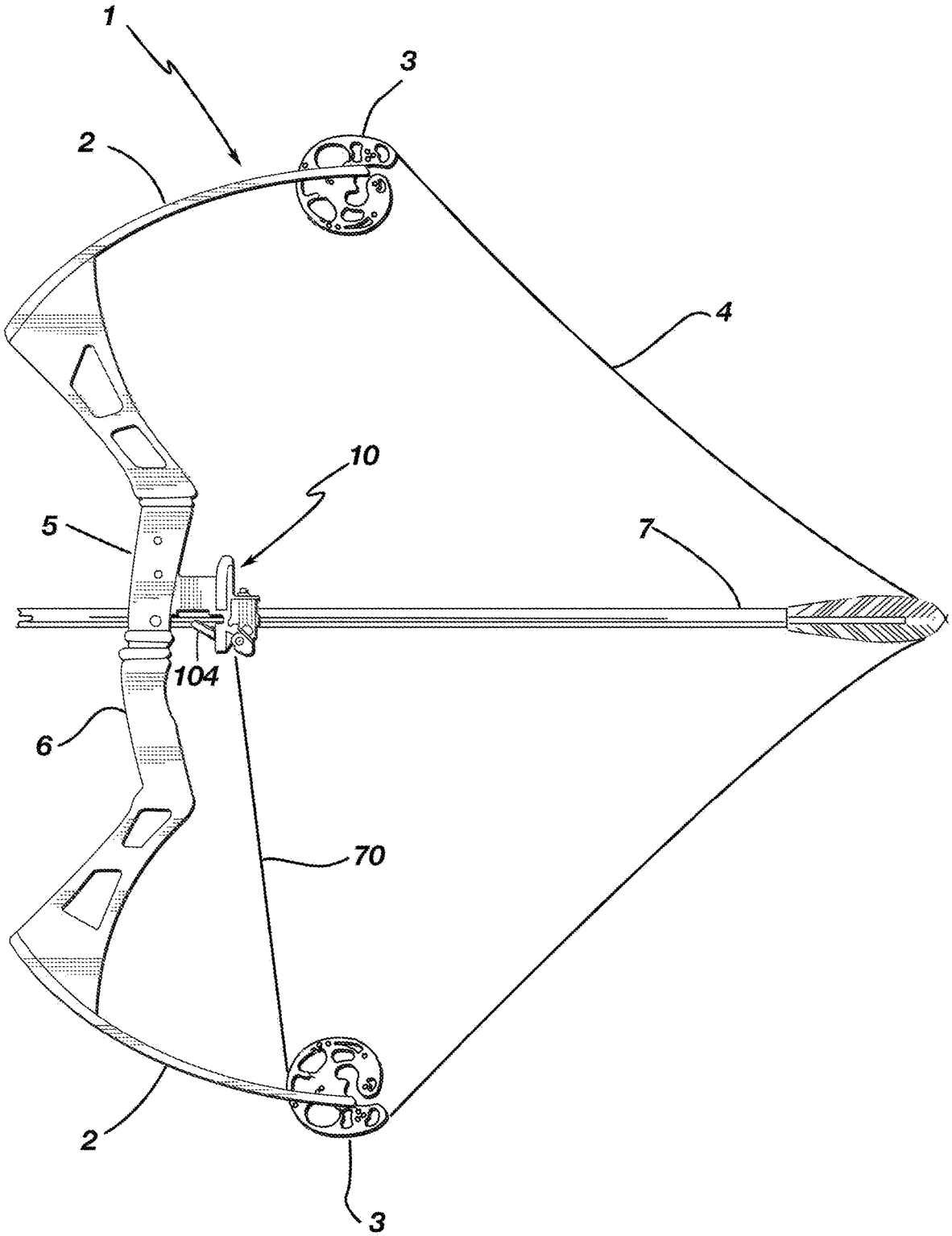
FIG. 3 is a side elevational view of a compound bow with the drop-a-way dual mode archery rest in full draw position of the present invention.
Figure 4:
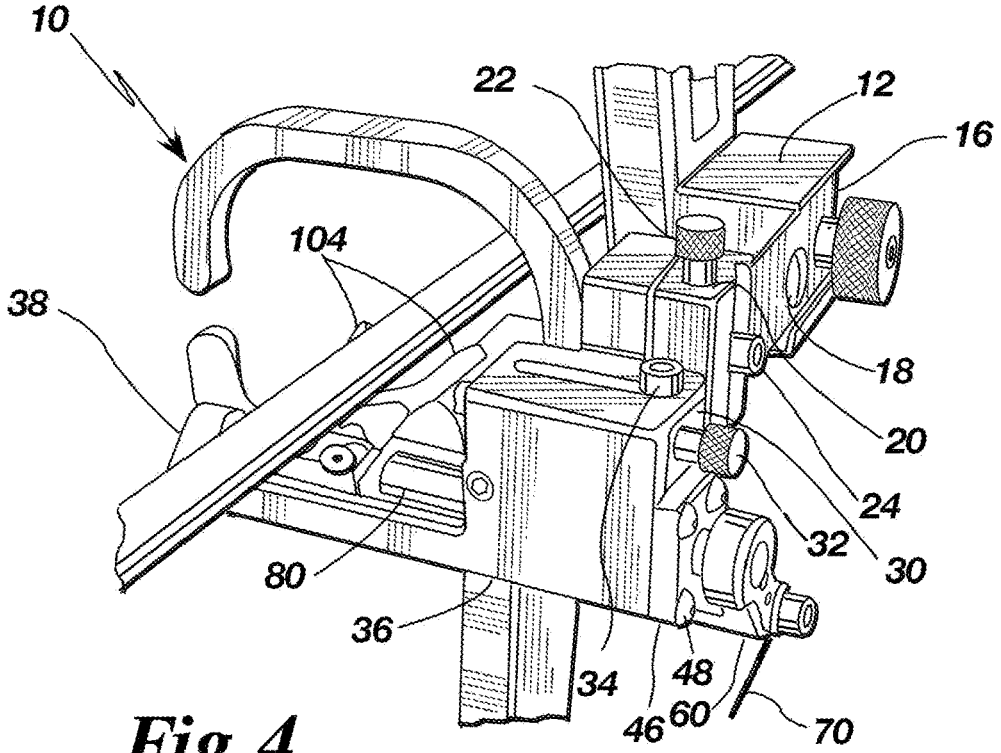
FIG. 4 is a front perspective view of the archery rest of the present invention mounted on a broken away bow in fully rest position.
Figure 5:
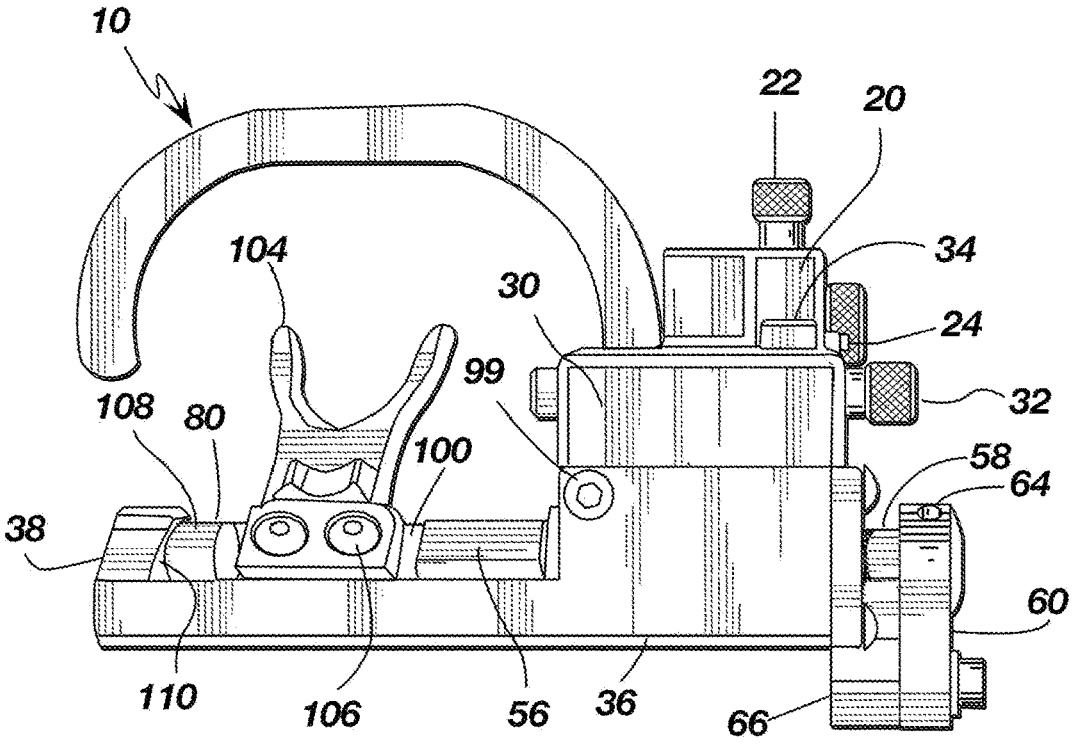
FIG. 5 is a front perspective view of the archery rest of the present invention mounted on a broken away bow with the arrow launcher in fully upward position.
Figure 6:
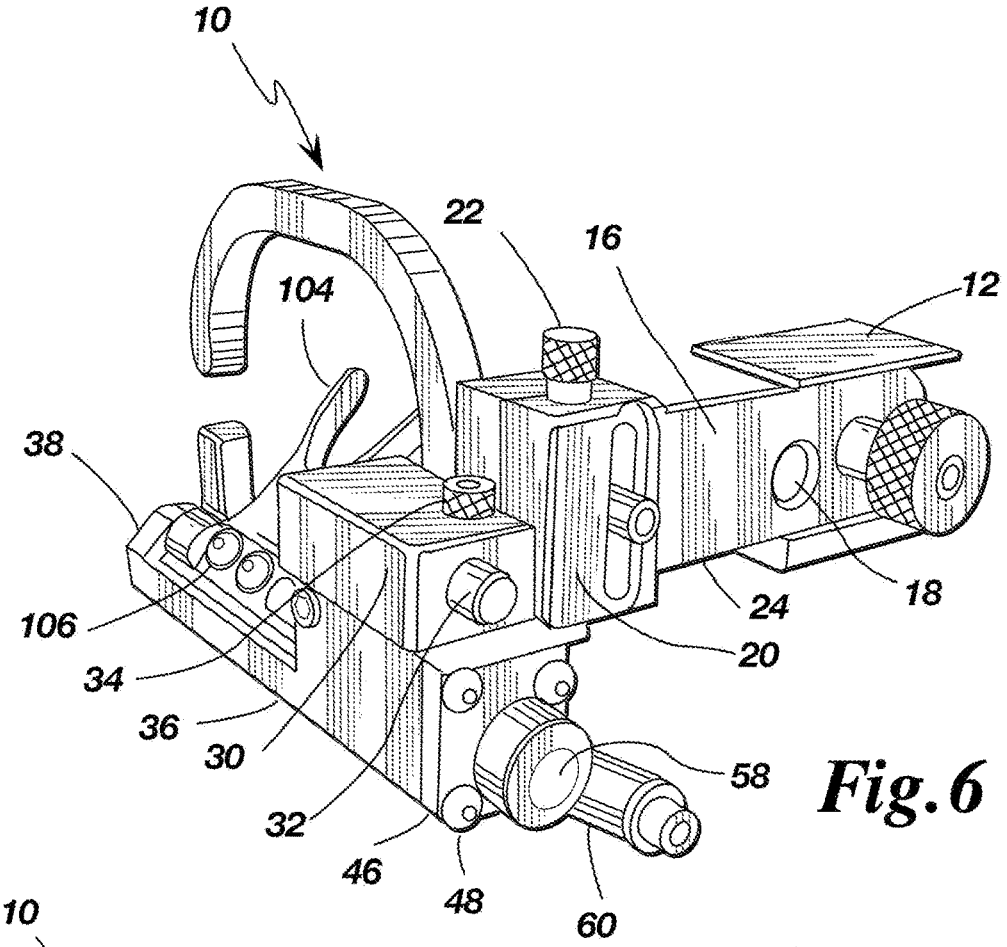
FIG. 6 is a right front perspective view of the archery rest of the present invention mounted on a broken away bow with the arrow launcher in fully upward position clearly showing X, Y and Z axes adjustments.

Referring to FIGS. 1 through 3, the compound archery bow 1 and the archery bow dual mode drop-a-way arrow rest 10, mounted on the riser 5 of the bow may be generally understood.

The bow 1 includes upper and lower limbs 2 with cams 3 at their distal ends. The cams 3 are connected by the bow or draw string 4. In the center area of the bow structure are located riser 5 and grip 6. Arrow 7 may be supported on the bow 1 by the archery dual mode drop away arrow rest 10 of the present invention. FIG. 1 shows the archery bow 1 at rest and the arrow launcher 104 in the down out of the way position. FIG. 2 shows the archery bow 1 partially drawn back and the arrow launcher 104 beginning to be raised. FIG. 3 shows the archery bow 1 fully drawn back and the arrow launcher 104 fully raised.

Referring to FIGS. 4 through 15, the exterior parts and outer structures may be learned.

A rest 10 C-shaped riser channel mount 12 with threaded apertures may be mounted to the bow riser 5 with spacer block 14 and an arrow rest mounting bracket 16 with machine screws and nuts or threaded apertures. The bracket 16 has multiple aligned horizontal apertures or an elongate slot 18. This structure allows for movable mounting adjustments in the Z axis moving the bow toward or away from the face of the archer. The proximal end of the bracket 16 supports vertical adjustment 20 with a knurled knob 22 and a machine set screw 24. This structure allows for vertical adjustments in the Y axis of the arrow rest 10 in relation to the mounting bracket 16. The horizontal adjustment 30 with knurled adjustment knob 32 and set screw 34 features is secured to the vertical adjustment 20 for X axis adjustments.

Elongate launcher housing 36 is connected to and below the horizontal adjustment 30. Distal from, but connected to, the launcher housing 36 is a L-shaped launcher portion 38 which press fit receives the distal end of the launcher shaft 80. Opposite the L-shaped launcher portion in the housing 36 are spring index apertures 42 (FIG. 13) as will be explained later herein.

Figure 7:
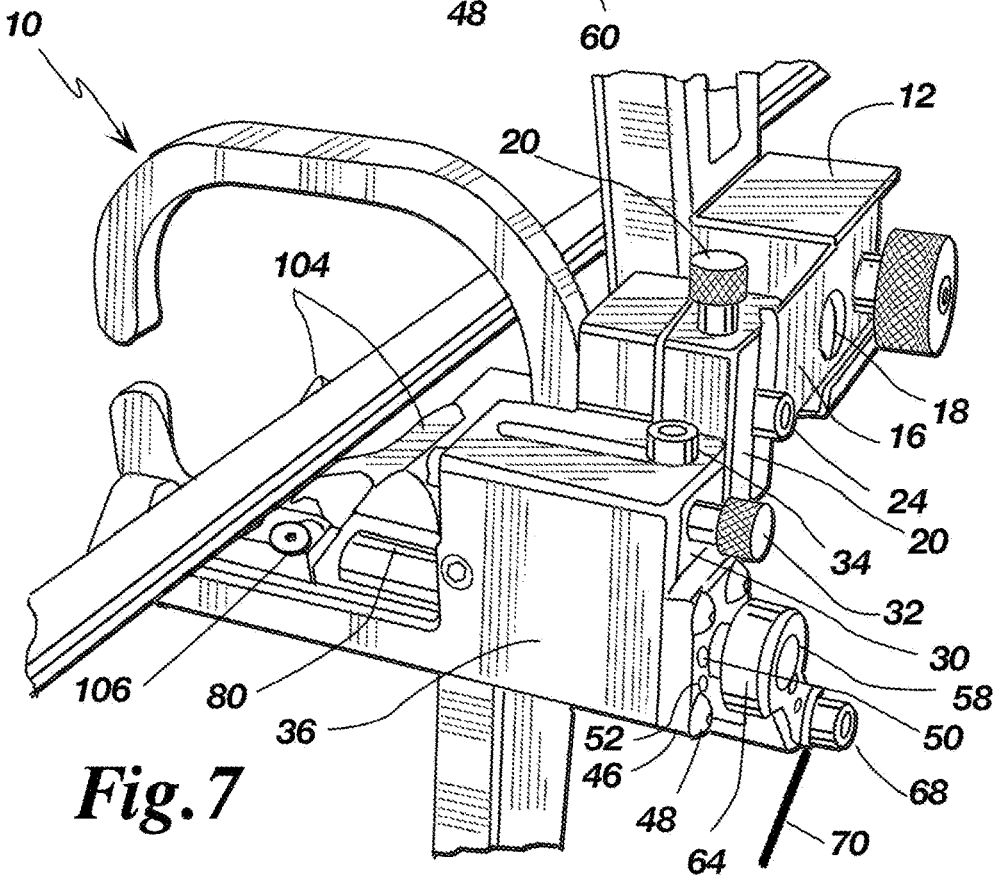
FIG. 7 is a right front perspective view of the archery rest of the present invention mounted on a broken-away bow with the arrow launcher fully in rest down-position clearly showing X, Y and Z axes adjustments.
Figure 8:
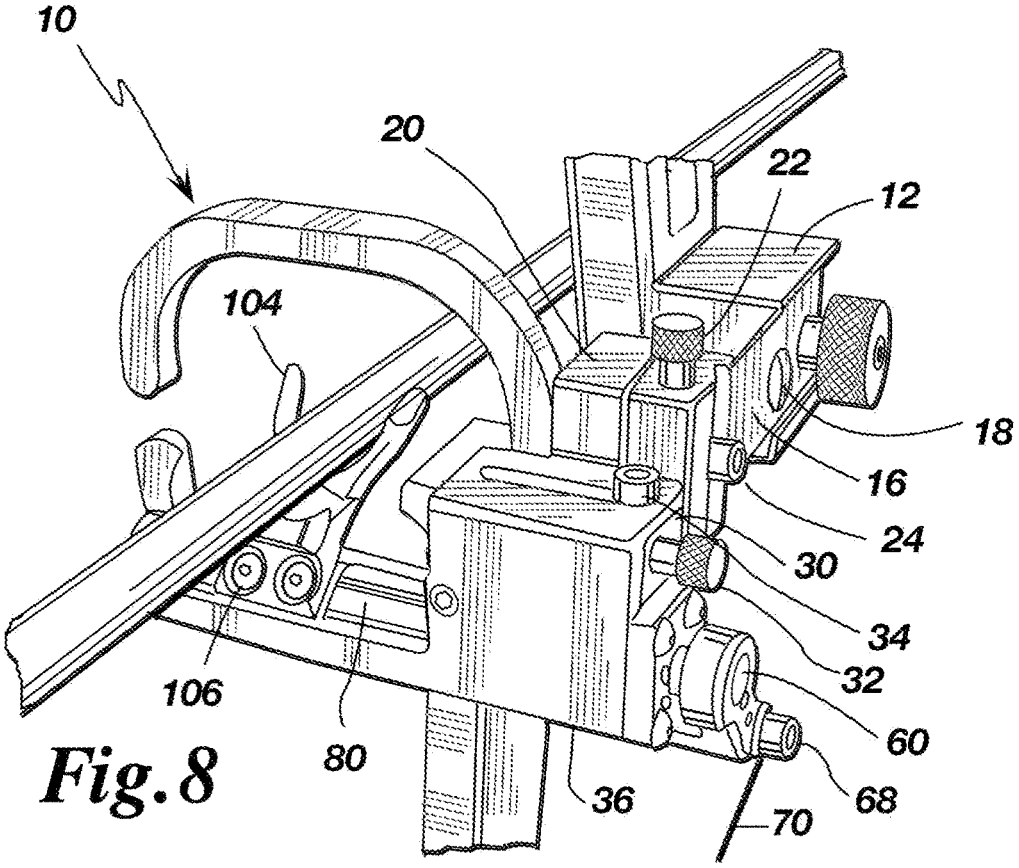
FIG. 8 is a right front perspective view of the archery rest of the present invention mounted on a broken away bow with the arrow launcher in fully upward position clearly showing X, Y and Z axes adjustments.

The launcher housing 36 may have a detachable right end wall 46 for gaining access to the interior of the launcher housing 36. The right end 46 wall may be secured to the housing 36 with machine screws 48. The end wall 46 also has spring index aperture(s) 52 (FIG. 7).

Figure 14:
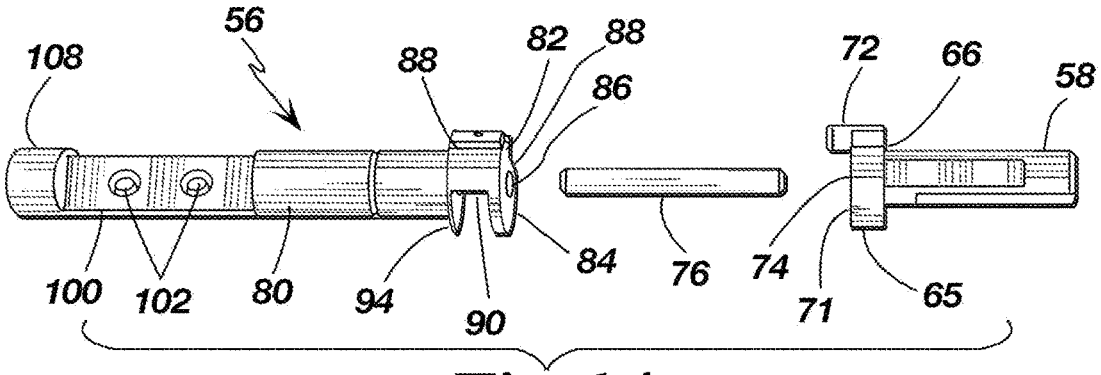
FIG. 14 is an exploded elevational view of the three part arrow rest launcher shaft.
Figure 15:
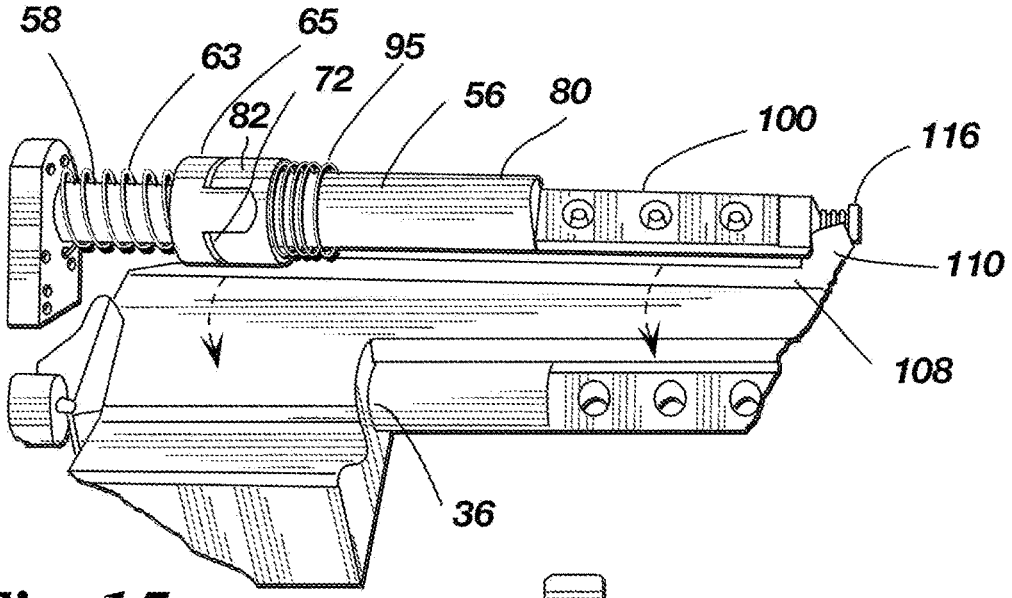
FIG. 15 is an elevational view of the three part arrow rest launcher shaft and broken away dashed arrows showing the arrow rest launcher shaft in position and attached to the right end wall of the launcher housing with springs attached and collar with internal bearing and a securement machine screw.

Referring to FIGS. 14 through 15, the structure and operation of the arrow rest launcher shaft 56 may be appreciated. The arrow rest shaft 56 is comprised of 3 indexing and interconnecting shafts including the thumb knob shaft 58, the axial alignment indexing slidable connecting shaft 76 and the launcher shaft 80.

Figure 9:
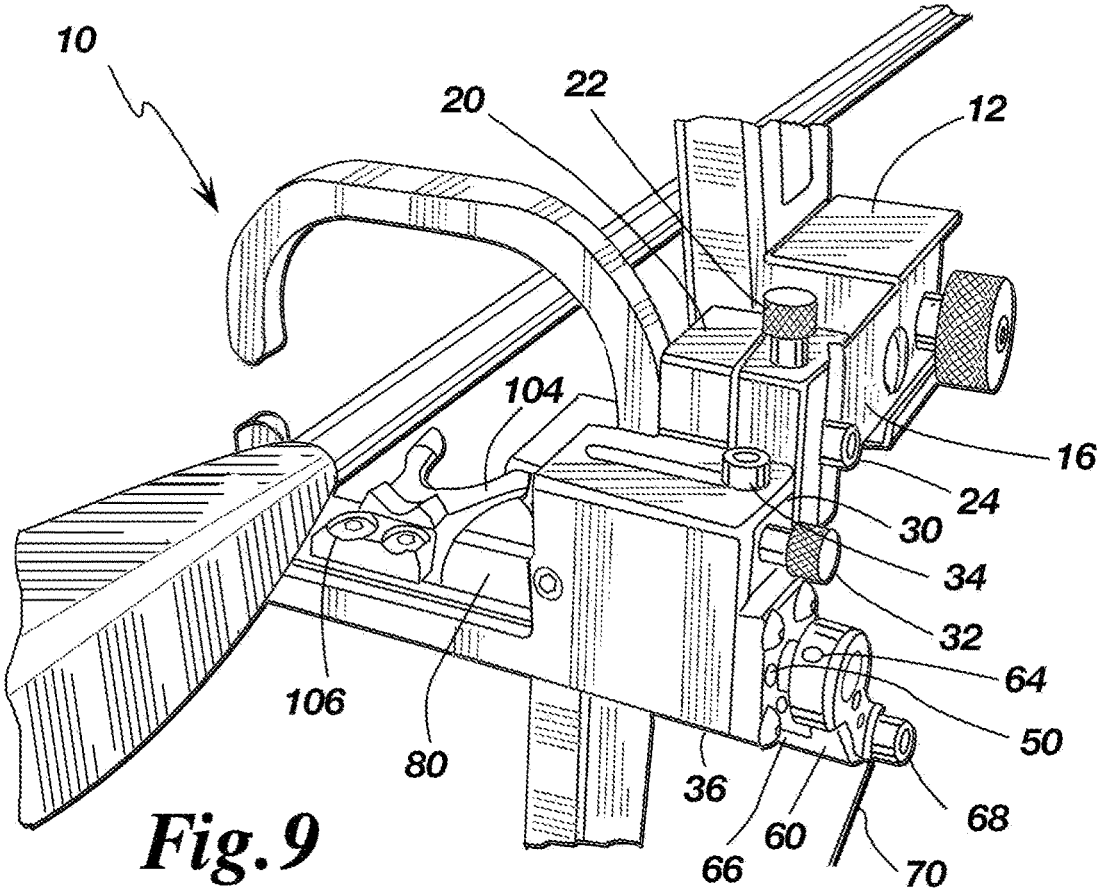
FIG. 9 is a right front perspective view of the archery rest of the present invention mounted on a broken away bow with the arrow launcher in downward rest position clearly showing X, Y and Z axes adjustments and an arrow being loaded into the archer rest.
Figure 10:
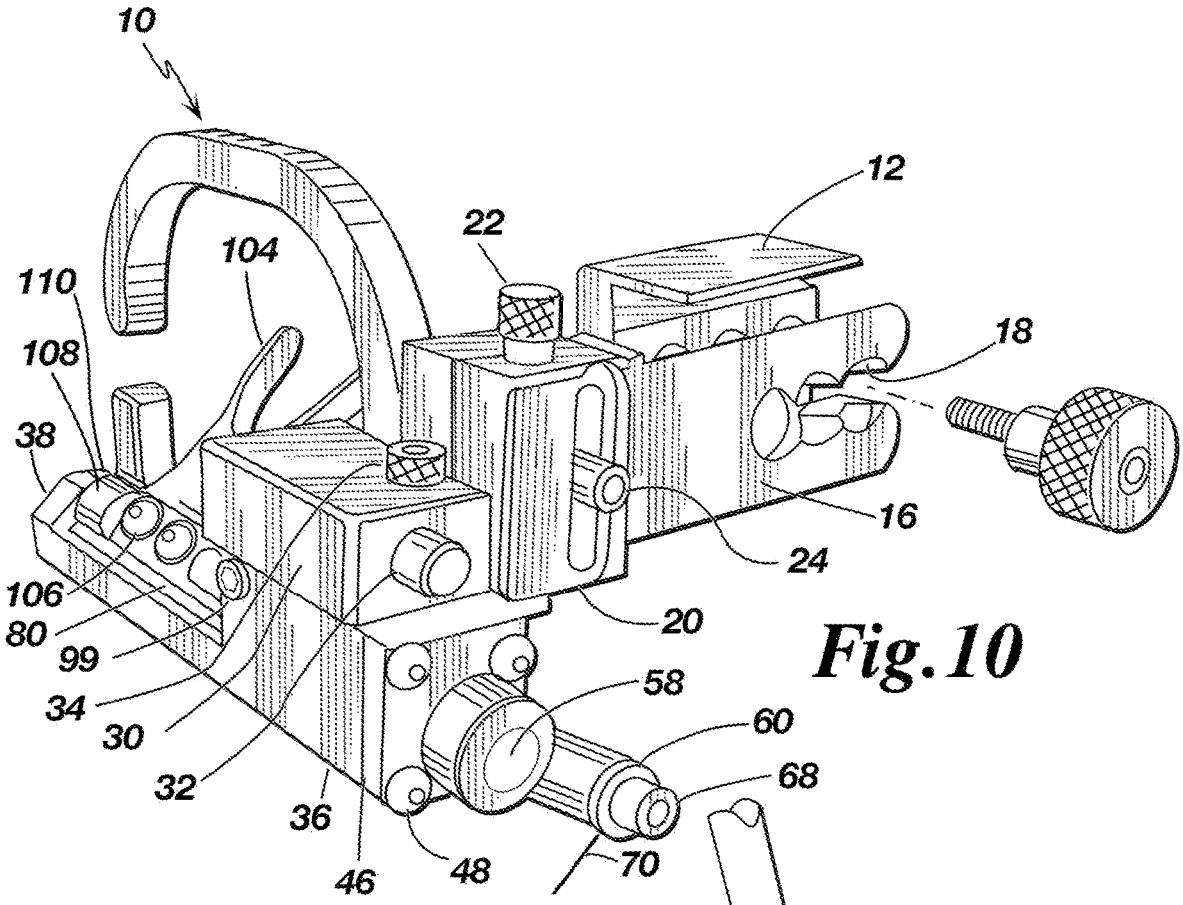
FIG. 10 is a right front perspective view of the archery rest of the present invention mounted on a broken away bow with the arrow launcher in fully upward position clearly showing the Z axis adjustments removed from the archery rest as to remove the archery rest for storage.
Figure 16:
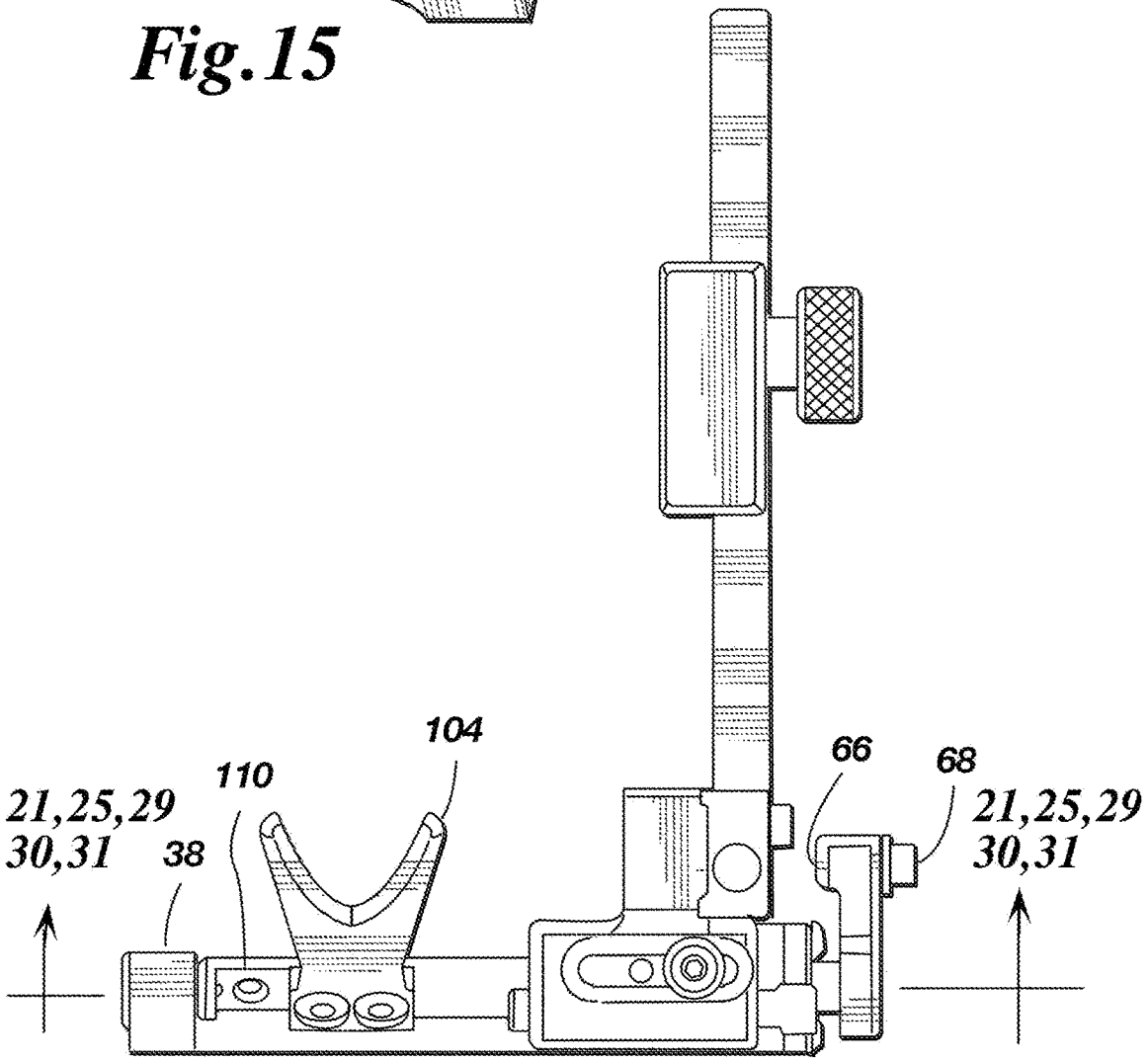
FIG. 16 is a top plan view of the archery rest of the present invention.
Figure 17:
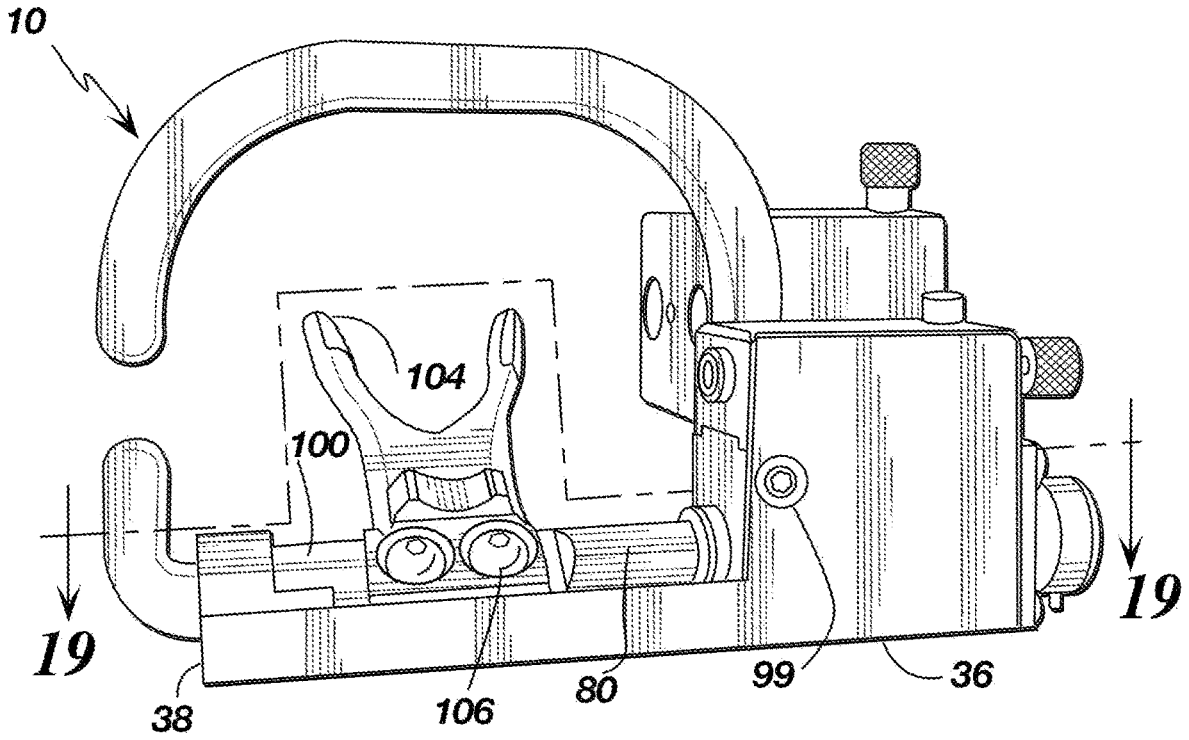
FIG. 17 is a front elevational view of the archery rest of the present invention.

Referring to FIGS. 16 through 31, the shaft 56 and operation of bow rest 10 may be appreciated and learned. FIGS. 16 and 17 show approximate cross section lines for FIGS. 19, 21, 24, 25, 27-29 and 31. The distal or outermost end of the thumb knob shaft 58 is where the thumb knob 60 is secured to the knob shaft 58 by a set screw 64 (FIG. 9). At the opposite end, the thumb knob 60 has a push surface 66 for the archer's thumb that is holding the bow grip 6. Opposite the push surface 66 is the arrow rest flexible connector, string or cable 70, and anchor set screw 68 which secures the arrow rest string 70 to the arrow rest shaft 56 and biased upwardly by the thumb knob shaft spring 63 as the other end of the string 70 is secured and tensioned to the lower bow limb 2, bow string 4 or bow cables (not shown). The thumb knob shaft 58 is journaled in the end wall 46 shaft aperture 50 (FIG. 7) and then extends into the housing 36. At the internal end of the thumb shaft 60 is a raised collar 82 with inner surface 66 that hold the thumb spring 63 while the other end of spring 63 has its end within the spring index aperture 52.

The collar 82 has a distal surface 71 which supports protruding outermost indexing and locking finger 72 and an axial aligned indexing aperture 74 in which slidably indexing shaft 76 is placed with the opposite end of indexing shaft 76 slidably fit into radial indexing aperture 86 of collar 82 of the launcher shaft 80 (FIG. 14).

Figure 11:
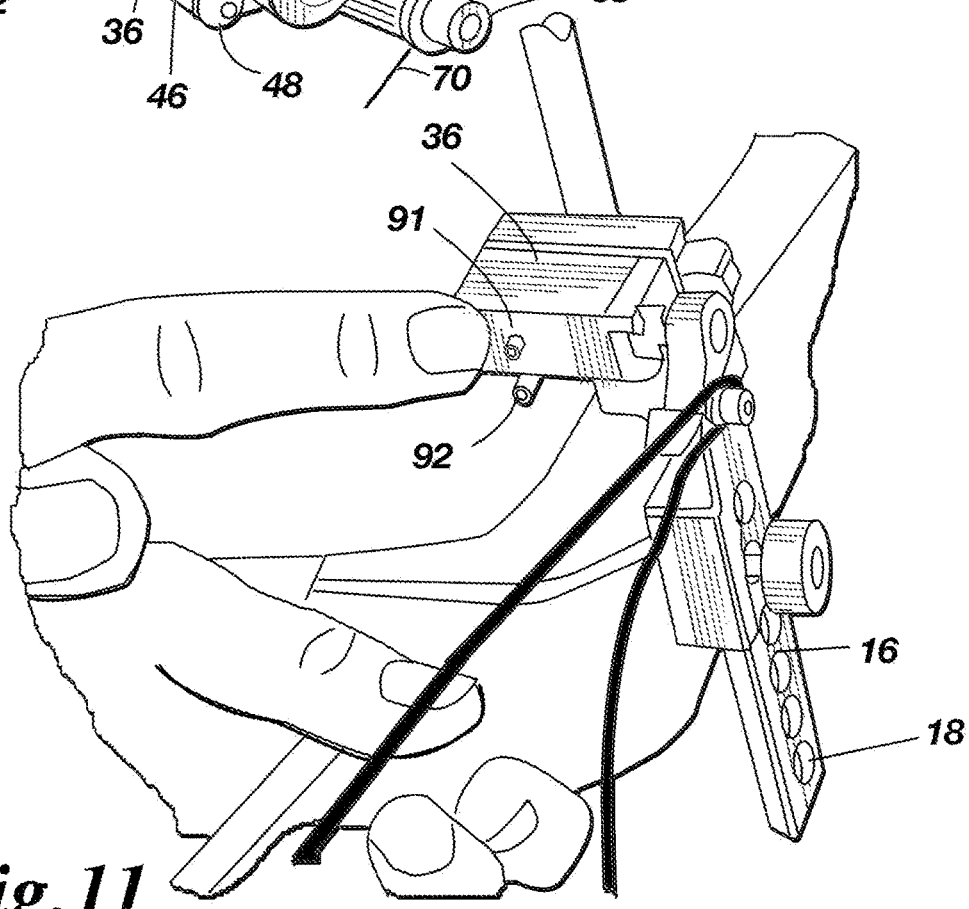
FIG. 11 is an underside perspective view of the archery rest showing the set screw adjustments for raising and lowering the launcher to fully up and fully down positions.
Figure 12:
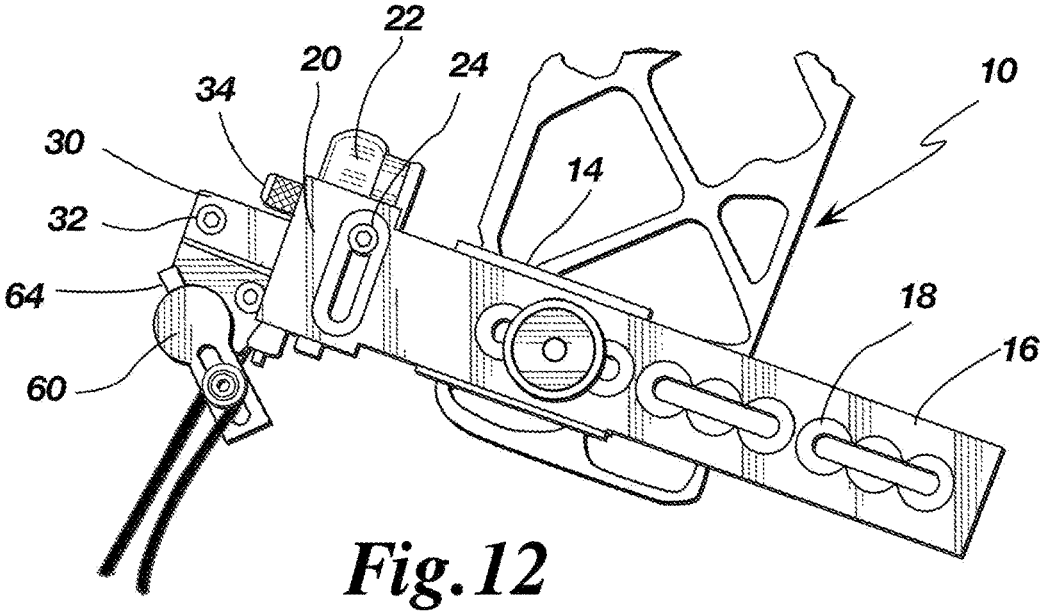
FIG. 12 is a right side elevational view of the archery rest of the present invention mounted on a broken away bow with the arrow launcher visible X, Y and Z axes adjustments and the archery rest thumb knob secured to the launcher actuation string or cable.
Figure 18:
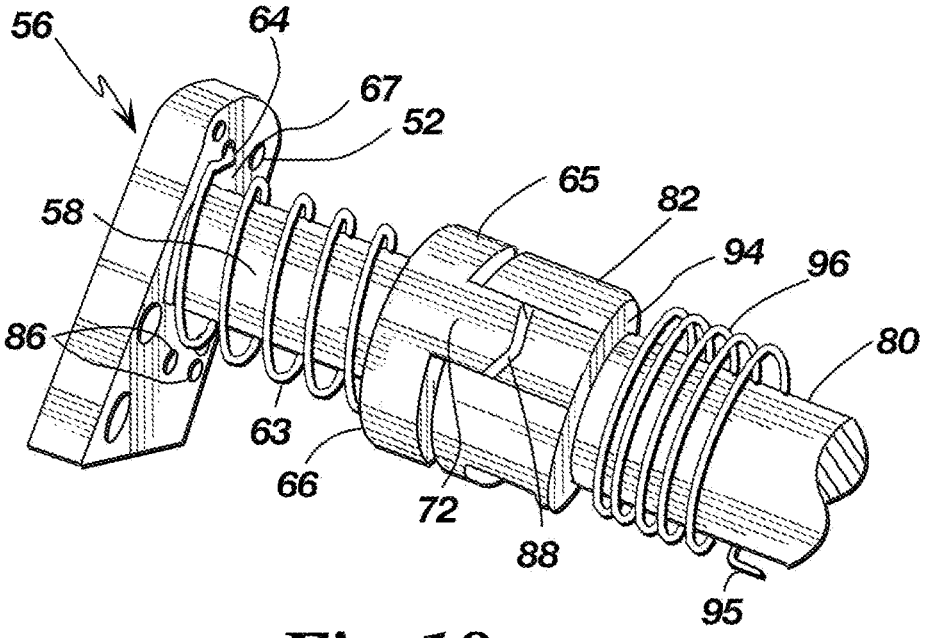
FIG. 18 is an elevational view of the housing right end wall with spring apertures, the thumb knob shaft engaged with the launcher shaft partially broken away and the two shaft springs on the two shafts.
Figure 19:
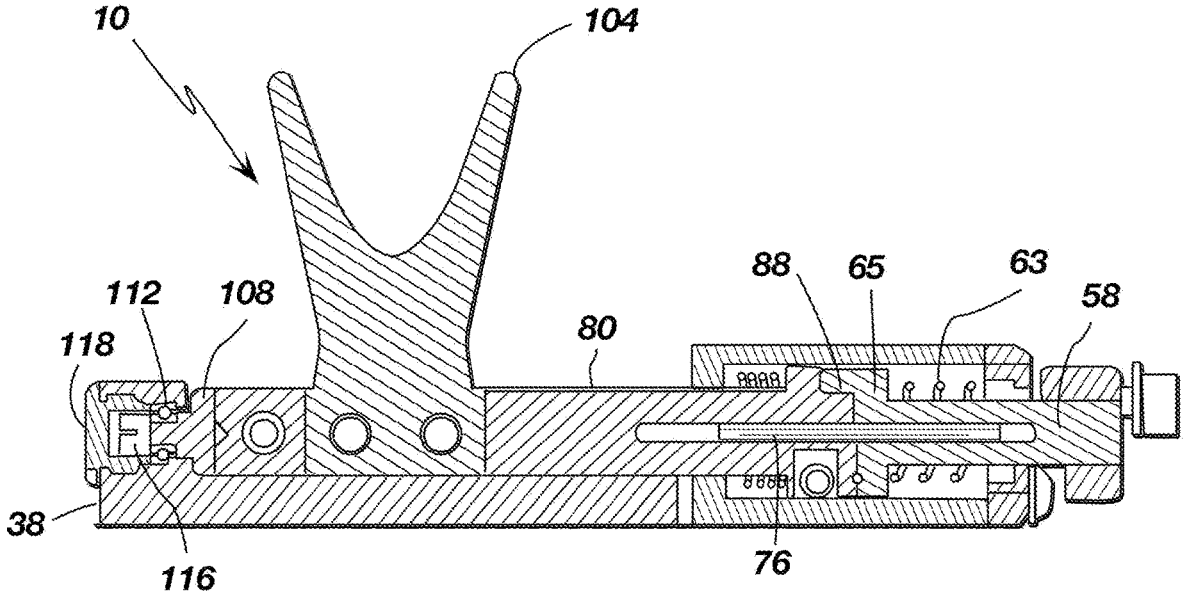
FIG. 19 is a cross sectional view taken along lines 19-19 of FIG. 17.
Figure 20:
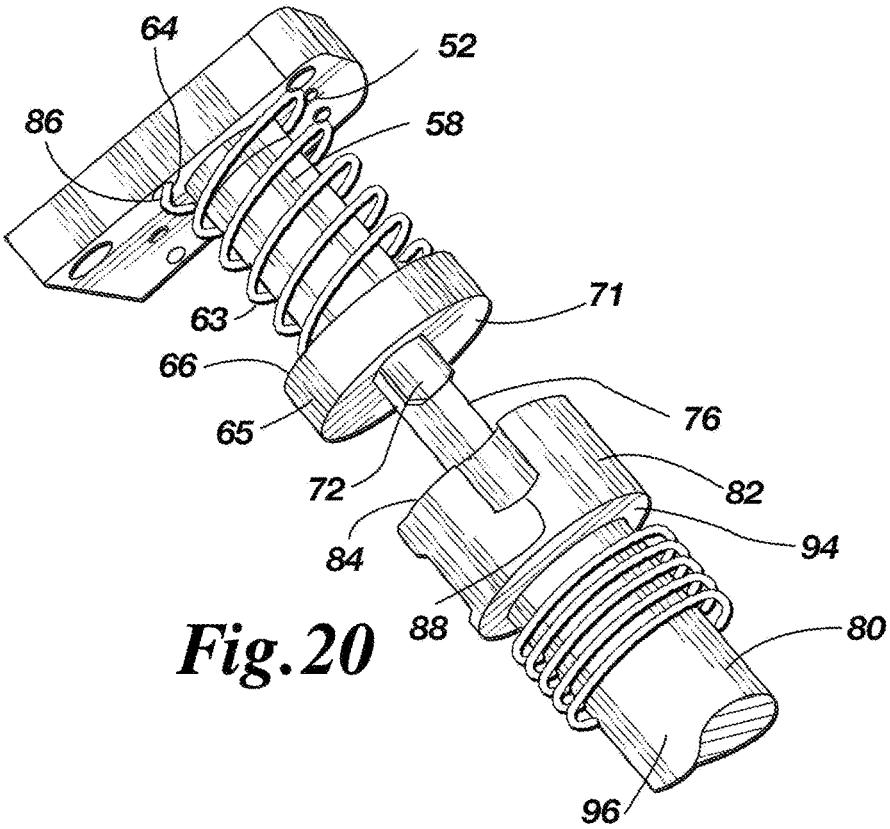
FIG. 20 is an elevational view of the housing right end wall with spring apertures, the thumb knob shaft separated from the launcher shaft partially broken away, the two shaft springs on the two shafts and the connecting axial alignment indexing slidable connecting shaft between the knob shaft and the launcher shaft.
Figure 21:
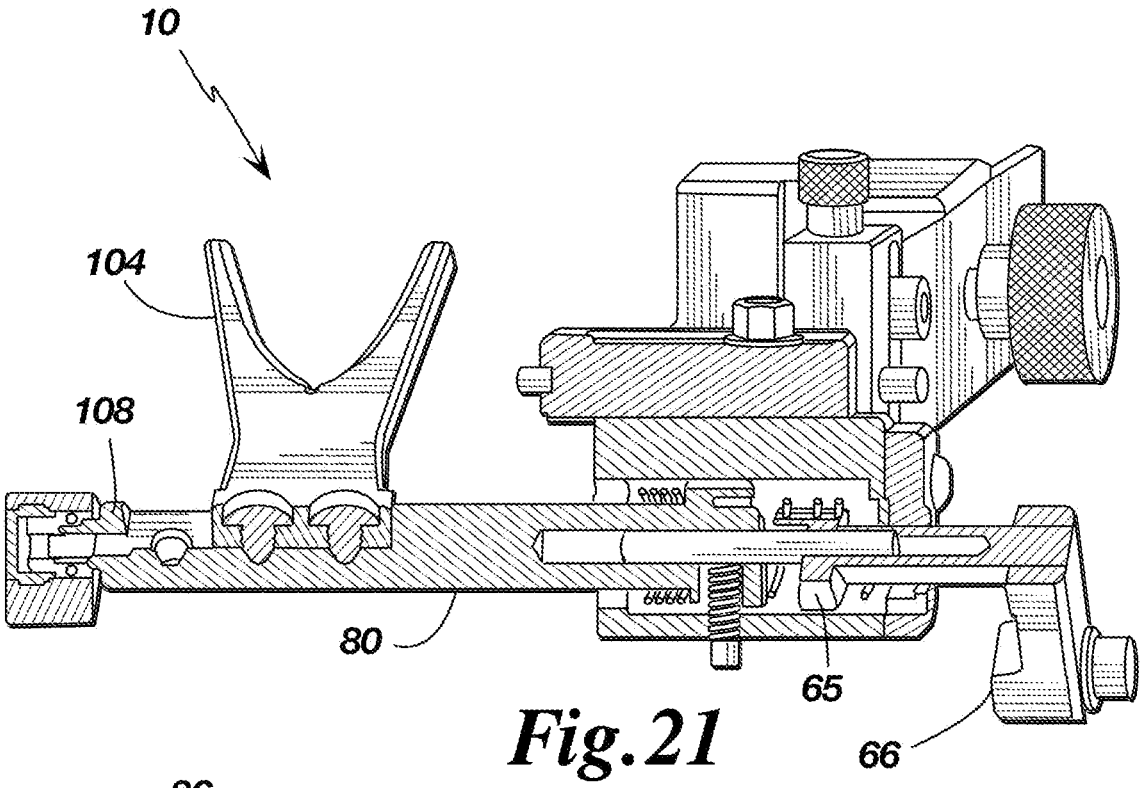
FIG. 21 is a cross sectional view taken along lines 21-21 of FIG. 16.

The collar also has an outer most axial locking finger channel 88 to receive finger 72 as to rotatably secure the launcher shaft 80 to the thumb knob shaft 58 within housing 36 (FIG. 18). The collar 82 also has a cut away or beveled portion 90 upon which adjustment screws 91 and 92 are indexed to adjust the height and lay down position of the launcher 104 (FIG. 11).

Figure 13:
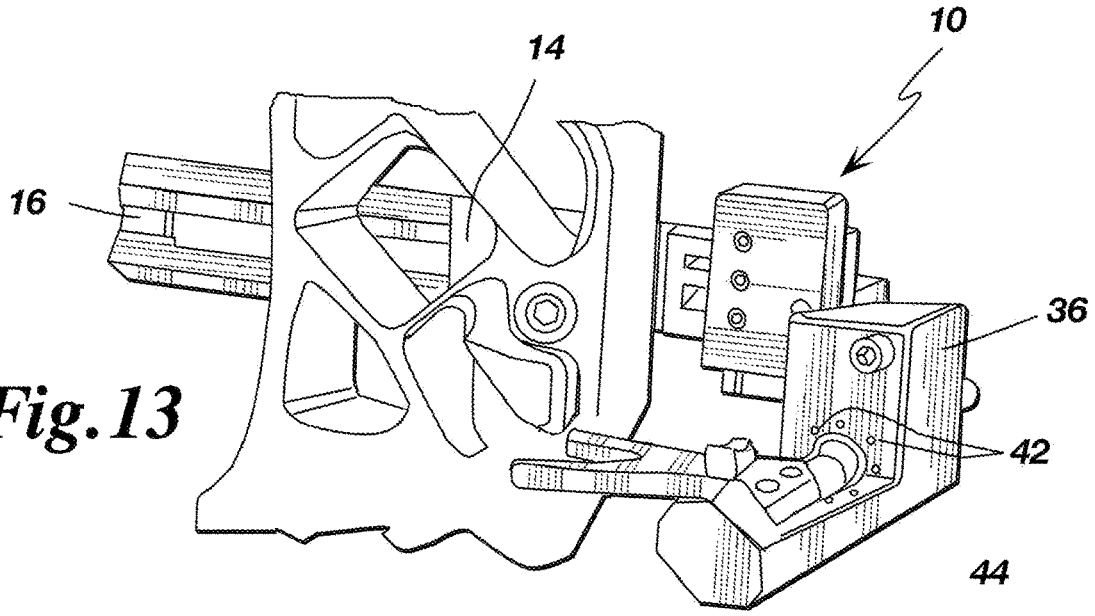
FIG. 13 is a left side elevational view of the archery rest of the present invention mounted on a broken away bow with the archery rest mounting bracket secured on the bow riser and shaft spring aperture(s) on the launcher housing.
Figure 22:
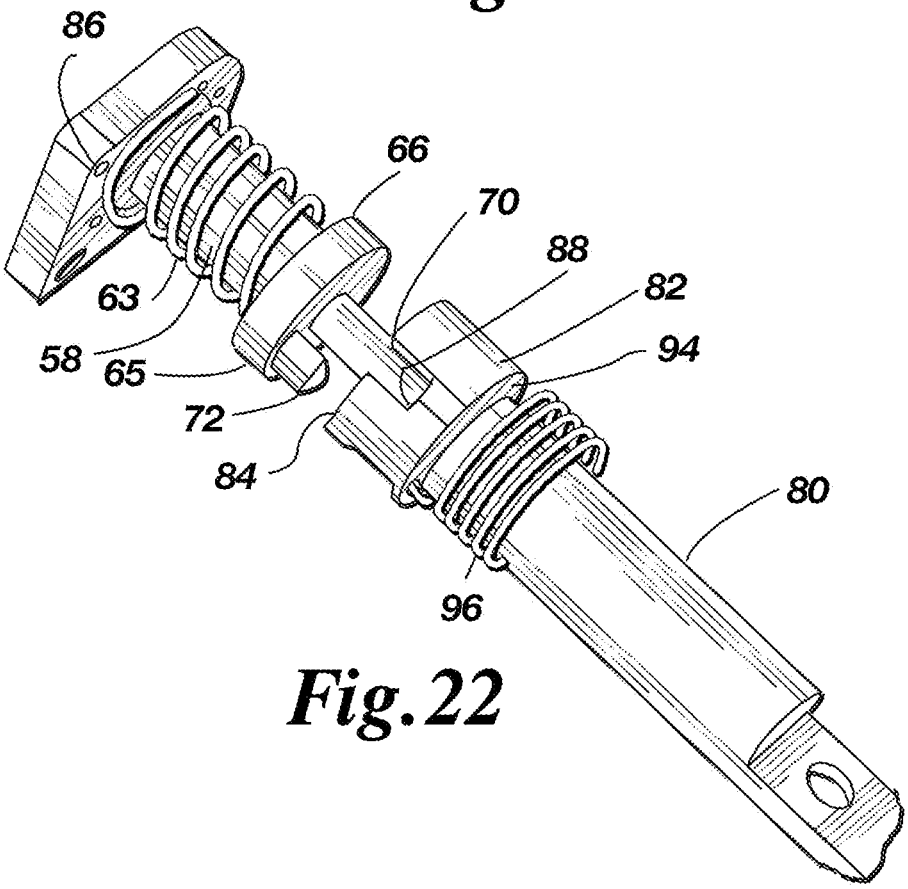
FIG. 22 is an elevational view of the housing right end wall with spring apertures, the thumb knob shaft rotated counterclockwise by the thumb knob shaft spring 63 separated from the launcher shaft partially broken away, and being connected to the launcher shaft by the axial aligned indexing slidable connecting shaft, the launcher being rotated to it upward position by the launcher shaft spring 96.
Figure 23:
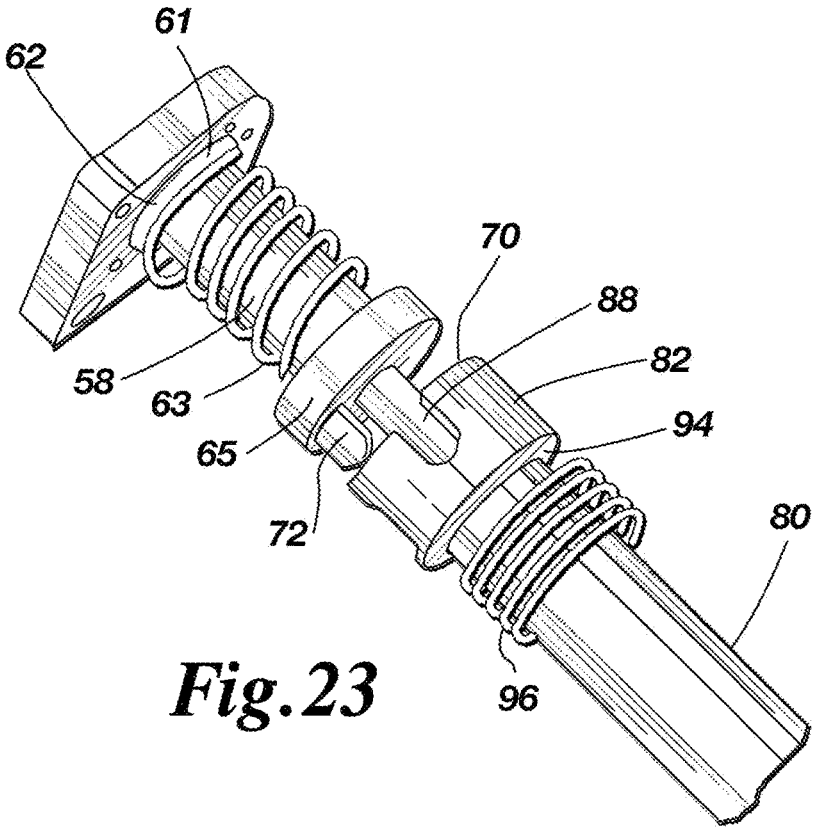
FIG. 23 is an elevational view similar to FIG. 22 with the archer bow being ready to be fully drawn back.
Figure 24:
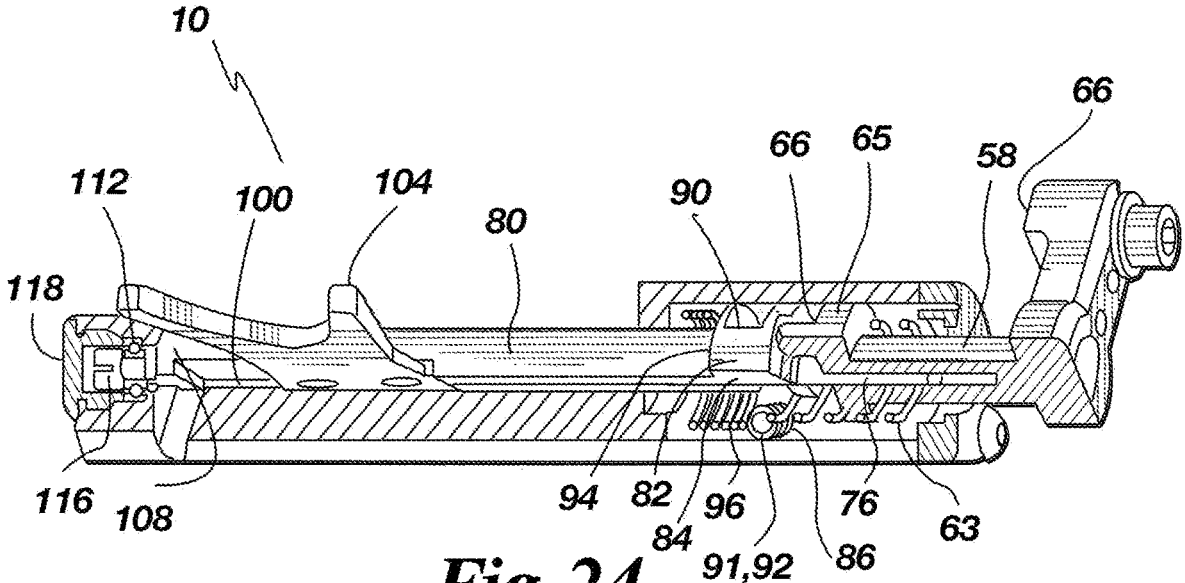
FIG. 24 is a cross sectional view similar to FIG. 21 taken from a front perspective at the beginning of bow draw back.
Figure 25:
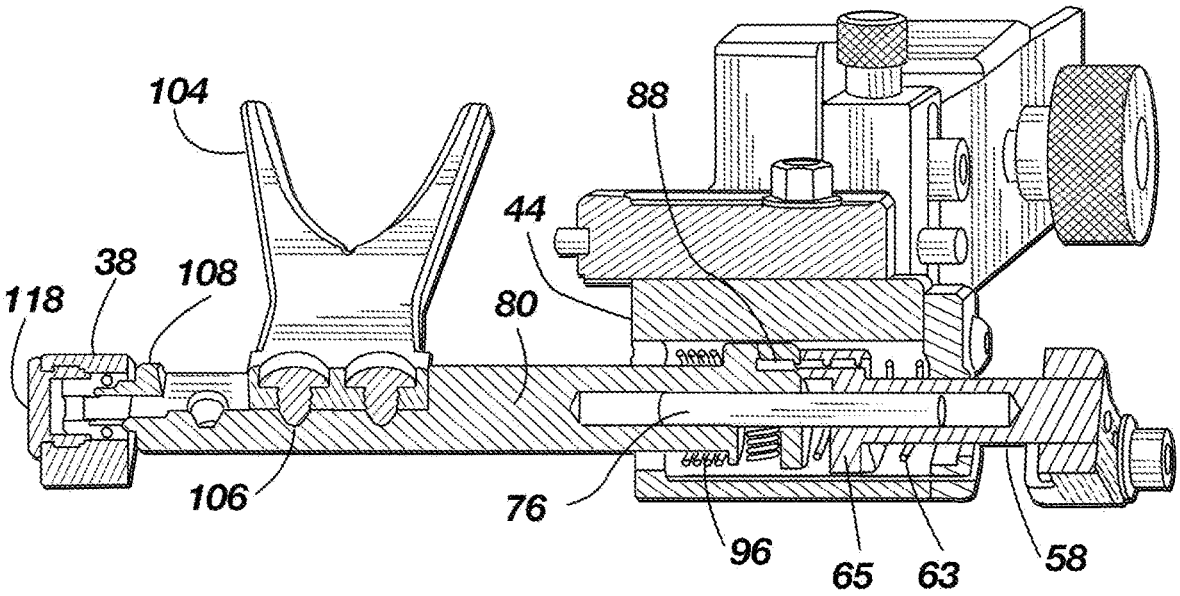
FIG. 25 is a cross sectional view similar to FIG. 21 with the bow being drawn back.
Figure 26:
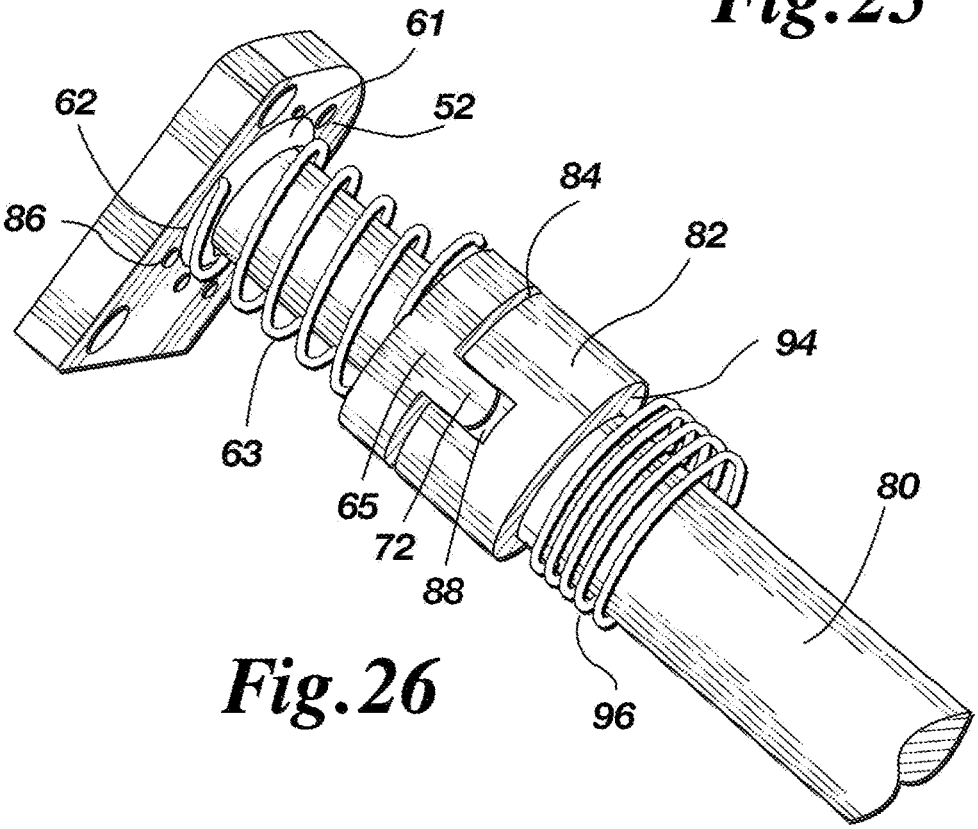
FIG. 26 is an elevational view of the housing right end wall with spring apertures, the thumb knob shaft rotated clockwise by the thumb knob shaft spring 63 connected to the launcher shaft by finger 72 engaging the finger channel partially broken away, and being connected to the launcher shaft by the axial aligned indexing slidable connecting shaft, the launcher still being in its upward position by the launcher shaft spring 96.
Figure 27:
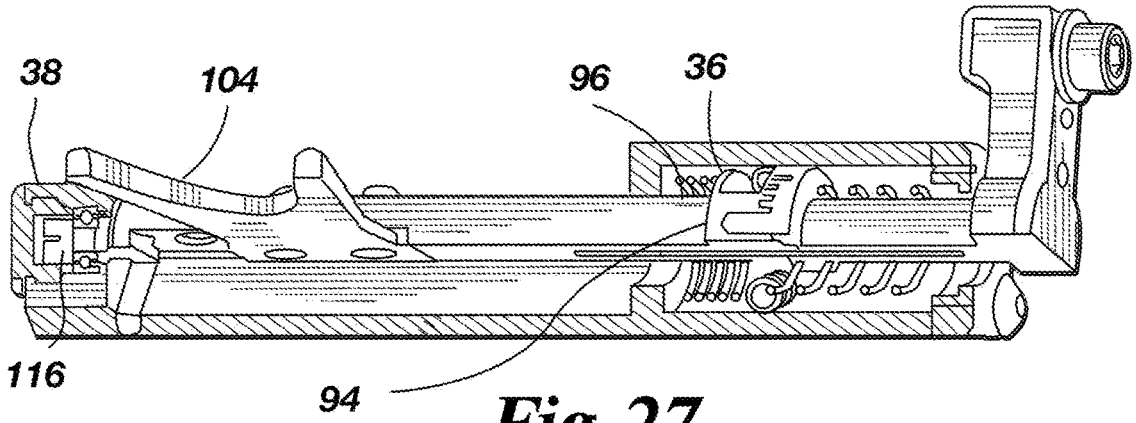
FIG. 27 is a cross sectional view similar to FIG. 17 with the bow being fully drawn back ready to be released.
Figure 28:
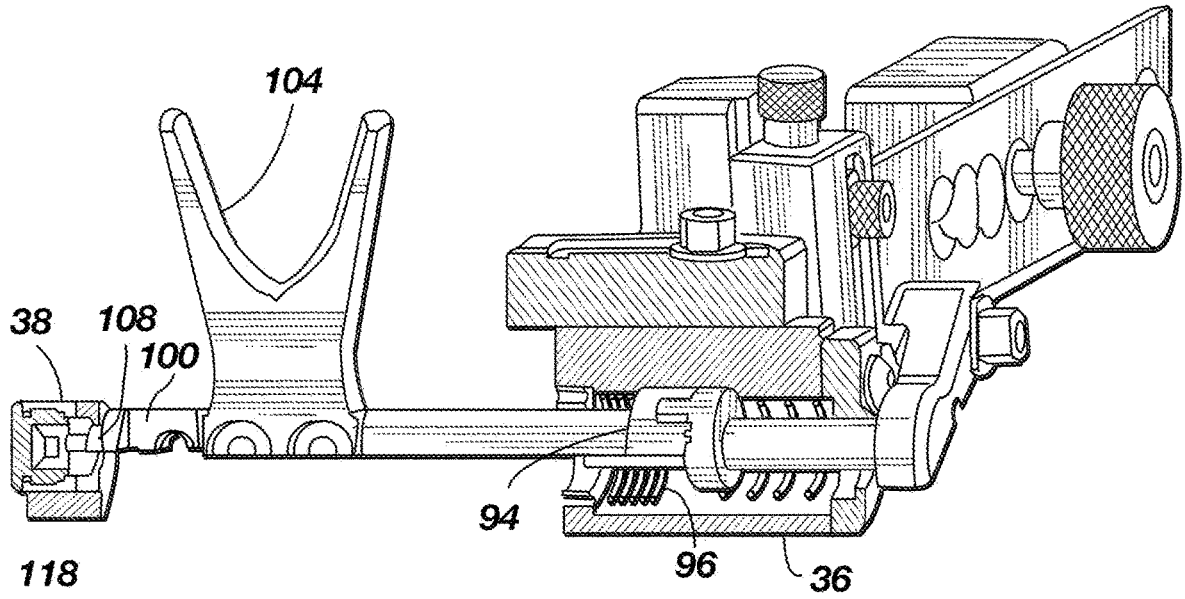
FIG. 28 is a cross sectional view similar to FIG. 27 just as the bow is beginning to be released.
Figure 29:
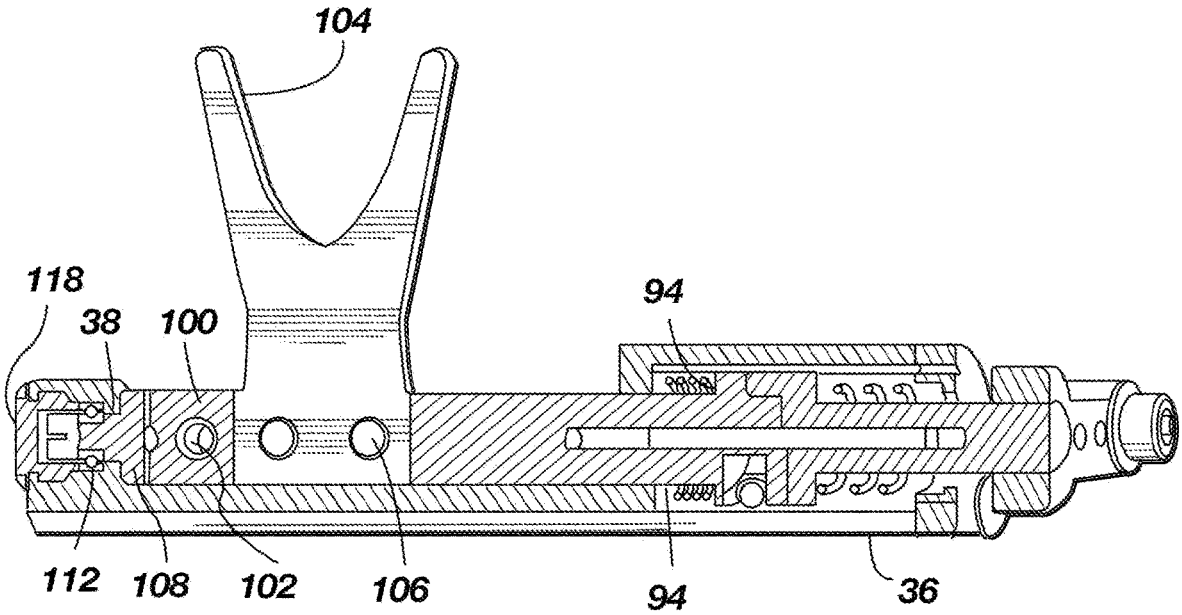
FIG. 29 is a cross sectional view similar to FIGS. 21 and 25 as the bow is released and under the biased tension of the thumb shaft spring 63, the thumb shaft engaged with the launcher shaft, the shaft counterclockwise rotate to quick lower the launcher.
Figure 30:
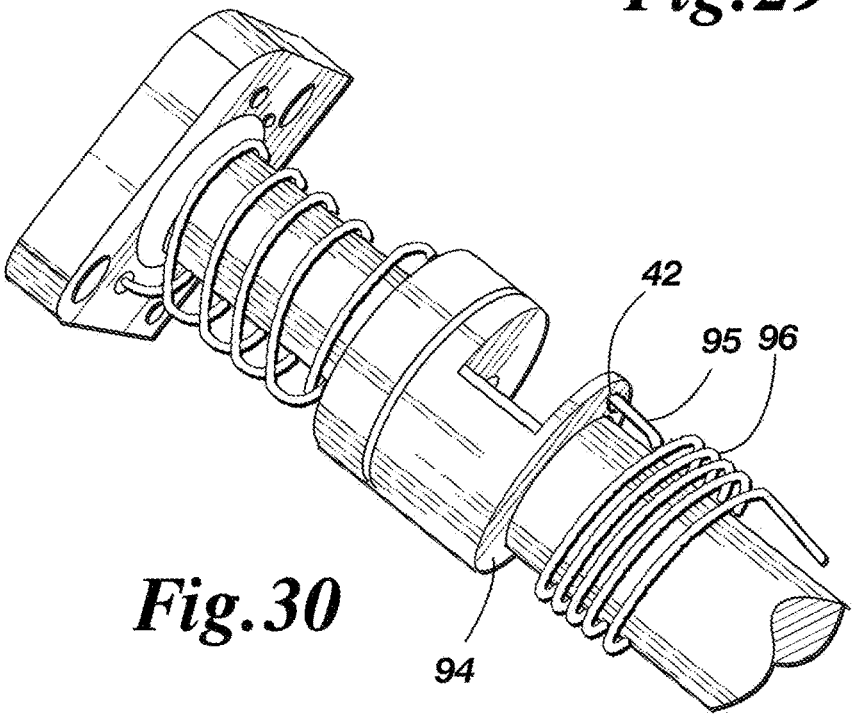
FIG. 30 is an elevational view similar to FIGS. 21, 25 and 29 with the thumb knob shaft rotating clockwise by the launcher activation string working against the tension of the thumb knob shaft and being connected to the launcher shaft causing the launcher to drop down and out of the way.
Figure 31:
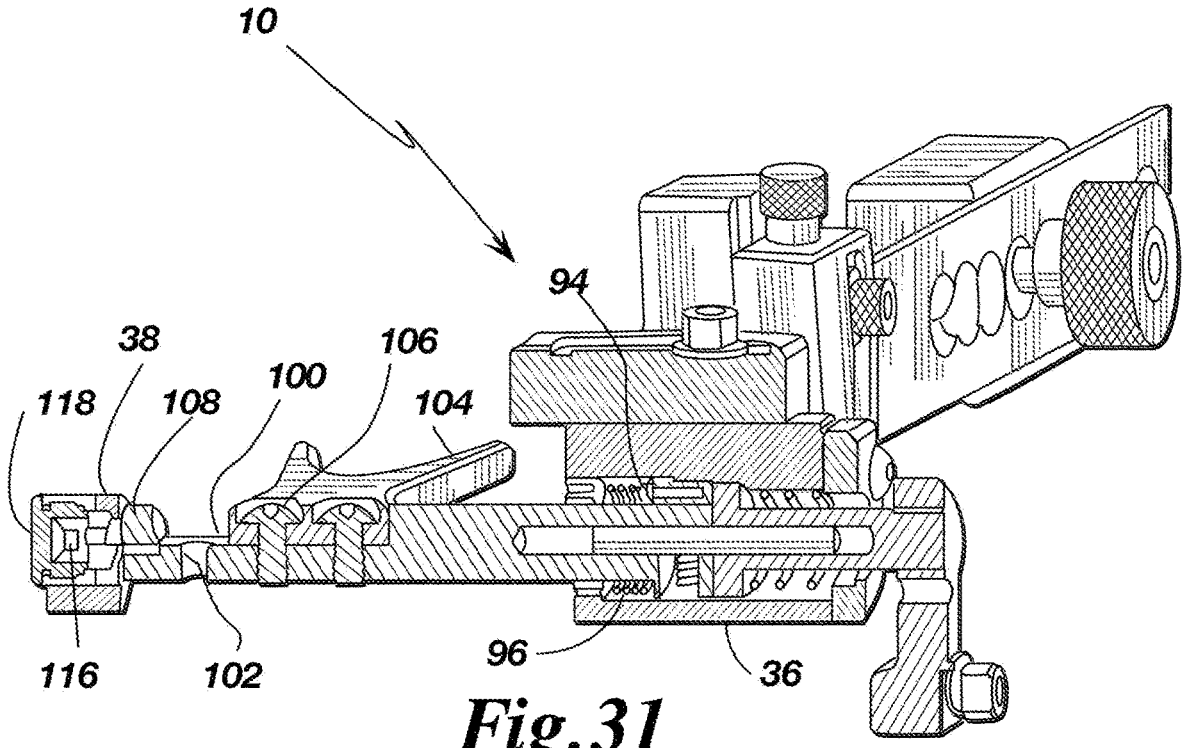
FIG. 31 is a cross section view similar to FIGS. 21, 25, 29 and 30 with the thumb knob shaft rotated clockwise by the launcher activation string working against the tension of the thumb knob shaft and being connected to the launcher shaft having caused the launcher to drop down and out of the way of the flying arrow.

Inner collar surface 94 indexes one end 95 of the collar compression/axially biased launcher spring 96 in aperture 42 (FIGS. 22, 30). While the other end of spring 96 is indexed into one of the housing spring apertures 42 (FIG. 13). A tensioning screw 99 (FIG. 5) an adjust the tension of spring 96 by force on the one end of the spring 96 adjacent collar 82. Moving distally along the launcher shaft 80, there is a flat beveled section 100 with threaded apertures 102. Launcher 104 has a lower portion with two apertures through which machine anchoring screws 106 secure the launcher 104 to the launcher shaft 80. At the distal end of launcher shaft 80 is collar 108 which supports internal bearings 112. The collar 108 is then press fit into launcher housing shaft aperture 44 located in the L-shaped launcher housing portion 38 and is enclosed by threaded end cap 118.

The operation of bow rest 10 may now be appreciated and learned. FIGS. 16 and 17 show approximate cross section lines for FIGS. 19, 21, 24, 25, 27-29 FIG. 31. In the bow 10 at rest position, the arrow launcher is lowermost and out of the way. The archer has a choice to shoot an arrow 7 from this position with an arrow 7 resting on a notch in the lower portion of the launcher 104. Alternatively, the archer may wish to shoot the arrow 7 with the launcher 104 in its upright position supporting the arrow 7. To shoot from the launcher 104 upright position, the archer simply pushes on the thumb knob push surface 66 which disengages the thumb knob indexing finger 72 from the axial locking finger channel 88 allowing the thumb knob 60 and shaft 58 to rotate the clockwise as the launcher spring 96 rotates the launcher shaft 80 as to lift the launcher 104 into its upright position under the influence of the launcher shaft spring 96. When the bow string is drawn back, the finger 72 rotates clockwise back into engagement with the axial locking finger channel 88. The bow string 4 can also be lowered to at rest position whereat the launcher 104 lays down to it lowermost position out of the way.

With the arrow loaded into the bow 1, the archer simply pulls back on the string 4 to the full draw position. When the bow string 4 is released, the arrow 7 begins to move forward. The lower limb 2 immediately moves downward toward its rest position pulling on the actuation string 70 which in turn pulls thumb knob 60 downward as to rotate the thumb knob shaft 58 under the influence of spring 63 to lower the launcher 104 to its downward out of the way position as to not touch the arrow 7 as it flies by.

The above Specification and accompanying Figures are for illustrative purposes only. The true scope of the present invention can be best understood by the following claims.

What is claimed:

1. A drop-a-way dual mode archery bow rest for an archery compound bow with bow limbs, a bow string, bow cables and a bow riser, the rest is used for supporting an arrow as the bow is drawn back to shoot the arrow, the rest is mounted on the riser of the compound archer bow, the bow rest comprising:

a) a housing having an enclosed left and right sides and is adjustable in X, Y and Z axes;

b) within the housing are positioned at least two slidably connected, rotatable, biased, horizontally and axially aligned arrow rest shafts mounted in the left and the right sides of the housing, the shafts are rotatably connected by an axially aligned indexing connecting shaft;

c) wherein at least one of the shafts is connected to a flexible connector which is turn is anchored to the bow limb, bow string or bow cable as to pull the arrow rest and launcher into a biased position for launch functionality; and d) an arrow launcher is attached to the one of the shafts whereby the arrow launcher can operate from down out of the way position or in an upward ready to shoot position lightly holding or supporting the arrow from below.

2. The drop-a-way bow rest of claim 1, wherein the arrow rest shafts comprise a launcher shaft extending outwardly from the housing and away from the riser and axially aligned with a thumb knob shaft with a thumb knob extending from the housing away from the launcher shaft, the launcher shaft and thumb knob shaft connected to each other by the indexing connecting shaft and the launcher shaft and the thumb knob shaft being connectable and independently rotatable independently of each other.

3. The drop-a-way bow rest of claim 2, wherein the launcher shaft and the thumb knob shaft are biased to move clockwise.

4. The drop-a-way bow rest of claim 2, wherein the launcher shaft and the thumb knob shaft are each biased by coil springs wrapped around each shaft.

5. The drop-a-way bow rest of claim 2, wherein the thumb knob shaft is slidably axially moveable to and from the launcher shaft by pushing outwardly on the thumb knob.

6. The drop-a-way bow rest of claim 1, wherein the elongate launcher housing has an outward L-shaped launcher portion which receives a distal end of the rotatable launcher shaft that is press fit thereinto.

7. The drop-a-way bow rest of claim 1, wherein the launcher shaft and the thumb knob shaft are releasably interlockable, moving the thumb knob outwardly will disconnect the launcher shaft and the thumb knob shaft while both shafts remain on the indexing connecting shaft.

8. The drop-a-way bow rest of claim 1, wherein the launcher shaft has a cut away launcher surface that receives indexing contact from two adjustment screws therebelow in the housing for raising and lowering adjustment of the launcher.

9. The drop-a-way bow rest of claim 1, wherein the flexible connector is anchored to the lower bow limb.

10. A drop-a-way dual mode archery bow rest for an archery compound bow with bow limbs, a bow string, bow cables and a bow riser, the rest is used for supporting an arrow as the bow is drawn back to shoot the arrow, the rest is mounted on the riser of the compound archery bow, the bow rest comprising:

a) a housing having an enclosed left and right sides and is adjustable in X, Y and Z axes;

b) within the housing are positioned a biased launcher shaft extending outwardly from the housing and away from the riser and axially aligned with a biased thumb knob shaft with a thumb knob extending from the housing away from the launcher shaft, the launcher shaft and thumb knob shaft connected to each other by an axially aligned indexing connecting shaft and the launcher shaft and the thumb knob shaft being connectable and independently rotatable independently of each other;

c) wherein thumb knob shaft is connected to a flexible connector which in turn is anchored to the bow limb, bow string or bow cable as to pull the arrow rest and launcher into a biased position for launch functionality; and d) an arrow launcher is attached to the launcher shaft whereby the arrow launcher can operate from a down out of the way position or in an upward ready to shoot position lightly holding or supporting the arrow from below.

11. The drop-a-way bow rest of claim 10, wherein the launcher shaft and the thumb knob shaft are biased to move clockwise.

12. The drop-a-way bow rest of claim 10, wherein the launcher shaft and the thumb knob shaft are each biased by coil springs wrapped around each shaft.

13. The drop-a-way bow rest of claim 10, wherein the thumb knob shaft is slidably axially moveable to and from the thumb knob shaft by pushing outwardly on the thumb knob.

14. The drop-a-way bow rest of claim 10, wherein the elongate launcher housing has an L-shaped launcher portion which receives a distal end of the rotatable launcher shaft that is press fit thereinto.

15. The drop-a-way bow rest of claim 10, wherein the launcher shaft and the thumb knob shaft are releasably interlockable, moving the thumb knob outwardly will disconnect the launcher shaft and the thumb knob shaft while both shafts remain on the indexing connecting shaft.

16. The drop-a-way bow rest of claim 10, wherein the launcher shaft has a cut away launcher surface that receives indexing contact from two adjustment screws therebelow in the housing for raising and lowering adjustment of the launcher.

17. The drop-a-way bow rest of claim 10, wherein the flexible connector is anchored to the lower bow limb.

18. A drop-a-way dual mode archery bow rest for an archery compound bow with bow limbs, a bow string, bow cables and a bow riser, the rest is used for supporting an arrow as the bow is drawn back to shoot the arrow, the rest is mounted on the riser of the compound archery bow, the bow rest comprising:

a) a housing having an enclosed left and right sides and is adjustable in X, Y and Z axes;

b) within the housing are positioned a clockwise biased launcher shaft extending outwardly from the housing and away from the riser and an axially aligned clockwise biased thumb knob shaft with a thumb knob extending from the housing away from the launcher shaft, the launcher shaft and thumb knob shaft connected to each other by an axially aligned indexing connecting shaft and the launcher shaft and the thumb knob shaft being connectable and independently rotatable of each other, wherein the thumb knob shaft is slidably axially moveable to and from contact with the launcher shaft by pushing outwardly on the thumb knob;

c) wherein the thumb knob is connected to a flexible connector which in turn is anchored to a lower bow limb portion as to pull the arrow rest and launcher into a launch position; and d) an arrow launcher is attached to the launcher shaft whereby the arrow launcher can operate from a down out of the way position or in an upward ready to shoot position holding the arrow from below.

19. The drop-a-way bow rest of claim 18, wherein the elongate launcher housing has an L-shaped launcher portion which receives a distal end of the rotatable launcher shaft that is press fit thereinto.

20. The drop-a-way bow rest of claim 18, wherein the launcher shaft and the thumb knob shaft are releasably interlockable, moving the thumb knob outwardly will disconnect the launcher shaft and the thumb knob shaft while both shafts remain on the indexing connecting shaft.

21. The drop-a-way bow rest of claim 18, wherein the launcher shaft has a cut away launcher surface that receives indexing contact from two adjustment screws therebelow in the housing for raising and lowering adjustment of the launcher.

* * * * *